US008297548B2

(12) United States Patent
Laurel et al.

(10) Patent No.: US 8,297,548 B2
(45) Date of Patent: Oct. 30, 2012

(54) SURFACE COVERING INSTALLATION TOOL AND METHOD

(75) Inventors: Martin Laurel, Las Vegas, NV (US); Leonard Izzo, Las Vegas, NV (US)

(73) Assignee: GES Exposition Services, Inc., Las Vegas, NV (US)

( * ) Notice: Subject to any disclaimer, the term of this patent is extended or adjusted under 35 U.S.C. 154(b) by 290 days.

(21) Appl. No.: 12/694,978

(22) Filed: Jan. 27, 2010

(65) Prior Publication Data

US 2010/0187350 A1 Jul. 29, 2010

Related U.S. Application Data

(60) Provisional application No. 61/147,670, filed on Jan. 27, 2009.

(51) Int. Cl.
*B65H 16/00* (2006.01)

(52) U.S. Cl. ..... 242/588; 242/588.2; 242/596; 242/129.51

(58) Field of Classification Search ..... 242/588, 242/588.1–588.2, 579, 596, 596.3, 610.2, 242/607.1, 129.51
See application file for complete search history.

(56) References Cited

U.S. PATENT DOCUMENTS

| | | | | | |
|---|---|---|---|---|---|
| 1,341,484 | A * | 5/1920 | Starratt | 242/588.2 |
| 2,666,595 | A * | 1/1954 | Eldh | 242/559.4 |
| 3,938,806 | A * | 2/1976 | Husbands | 473/494 |
| 4,226,380 | A * | 10/1980 | Gay | 242/588.2 |
| 4,575,020 | A * | 3/1986 | Strout et al. | 242/422.1 |
| 4,600,163 | A * | 7/1986 | Hummel et al. | 242/422.1 |
| 4,752,045 | A * | 6/1988 | Goldstein | 242/588.2 |
| 4,799,721 | A * | 1/1989 | Hale | 294/219 |
| 4,811,918 | A * | 3/1989 | Grooms | 242/419 |
| 5,351,905 | A * | 10/1994 | Ferber | 242/588.2 |
| 2006/0043232 | A1 * | 3/2006 | Teheran | 242/588 |

* cited by examiner

*Primary Examiner* — Sang Kim
(74) *Attorney, Agent, or Firm* — Snell & Wilmer L.L.P.

(57) ABSTRACT

A surface covering installation tool and method of use to provide improved safety and efficiency for surface covering installation. The surface covering installation tool is a tool that includes a handle, a mandrel, and a support member. A user inserts the mandrel into rolled surface covering and then pulls the rolled surfaced covering using the handle causing the surface covering to unroll.

3 Claims, 2 Drawing Sheets

SURFACE COVERING INSTALLATION TOOL AND METHOD

CROSS-REFERENCE TO RELATED APPLICATIONS

This application claims priority to U.S. Provisional Application Ser. No. 61/147,670, filed on Jan. 27, 2009 and entitled "SURFACE COVERING TOOL," which is incorporated herein by reference in its entirety.

FIELD OF INVENTION

This invention generally relates to a tool and method used to unroll surface covering material.

BACKGROUND OF THE INVENTION

There are numerous surface covering materials on the market today used in numerous industries. Some surface covering materials arrive from the manufacture, distributor, or storage warehouse as rolls of the material. A non exclusive list of examples might include carpets, mats, padding, linoleum, or certain roofing material. Various industries require mass installation of these surface coverings. Current methods of installation are highly inefficient and possess inherent health risks.

The current and perhaps most common method for a worker to roll out floor covering is the kick method. The kick method involves a worker at each end of the roll walking backwards and kicking each end of the roll with the sole of their shoes. As each worker kicks the roll forward, the roll typically drifts off the target covering area and becomes uneven and slack. Consequently, the workers must pull the covering straight and back to the proper area after they finish unrolling the roll. The kick method provides little control of the rolled surface covering. This allows the roll to get off line easily, necessitating a secondary operation to pull the carpet back in line. Secondary operations result in increased inefficiencies and increased likelihood of injury. Also, the repetitive movement and stress on the lower body while performing the kick method causes an increased likelihood of lower body injuries.

Another method occasionally used is the dolly method. In this method, a worker lifts the center of the unrolled portion of the surface covering roll with a dolly. This results in the roll rolling off the dolly shelf and moving forward a few inches. The worker then moves the dolly forward to pick up the unrolled portion of the roll. The worker then lifts and repeats the process. This method is inefficient because the dolly only moves the roll forward a very small distance each step. Using this method increase installation time consequently increasing costs.

Another method used is the kneeling method. In this method workers work from their hands and knees pushing the roll forward. This method is slow and forces workers to work from an awkward position, increasing the risk of injury to the workers.

These methods of rolling out floor covering causes back, knee, and muscle injuries. The frequency of these injuries is exacerbated by the scale of large installation projects and the minimal time allotted to accomplish the installation.

An exemplary industry that performs massive rolled surface covering jobs is the exposition services industry. In the exposition services industries, work crews install tens of thousands of linear feet of padding and carpet before an exposition begins. To begin the carpet installation at an exposition, the workers unload the carpets from trucks using dollies and deliver them to the show room floor. On the show room floor, the workers use the kick method to roll out the carpets across the show room floor. Using the kick method it takes approximately two to two-and-a-half minutes in order to unroll an average carpet section. After each carpet section is unrolled, the workers perform a second operation to straighten out the carpet and move it to the correct location. The workers then tape down individual sections of the carpets. Because of installation time constraints, workers are only given a narrow window of time to install floor coverings. The redundancy of the awkward labor causes the workers numerous injuries. These injuries increase the employer's workman's compensation premiums. Further costs are added due to extreme inefficiencies based on the two to two-and-a-half minute time requirements for unrolling each of the floor coverings. The added inefficiency of accomplishing the secondary operations of straightening and taping the surface coverings adds even more costs.

Due to the cumulative costs between high workman's compensation coverage requirements, lengthy covering rollout times, and unnecessary secondary operations an improvement in the industry is needed.

SUMMARY OF THE INVENTION

A surface covering installation tool is disclosed. This tool is used to unroll surface coverings that are packaged as rolls of the surface covering. In one embodiment, the tool comprises a handle, a mandrel, and a support member connecting to the handle on one end and the mandrel on the other end. The tool is used by inserting the mandrel into the center of a roll of surface covering. Then by pulling the handle in the opposite direction that the rolled surface is rolled, the tool will motivate the rolled surface covering to unroll in an efficient controlled manner. Using the tool can decrease installation time of a typical roll of carpet to less than thirty seconds.

BRIEF DESCRIPTION OF THE DRAWINGS

The accompanying drawings, wherein like numerals depict like elements, illustrate exemplary embodiments of the present invention, and together with the description, serve to explain the principles of the invention.

DETAILED DESCRIPTION

The detailed description of exemplary embodiments of the invention herein shows the exemplary embodiment by way of illustration and diagrams including the best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented.

Moreover, for the sake of brevity, certain sub-components of individual components and other aspects of the system may not be described in detail herein. Furthermore, the connecting lines shown in the various figures contained herein are intended to represent exemplary functional relationships and/or physical couplings between the various elements. It should be noted that many alternative or additional functional relationships or physical couplings may be present in a practical system. Such functional blocks may be realized by any number of components configured to perform specified functions.

Figure 1:
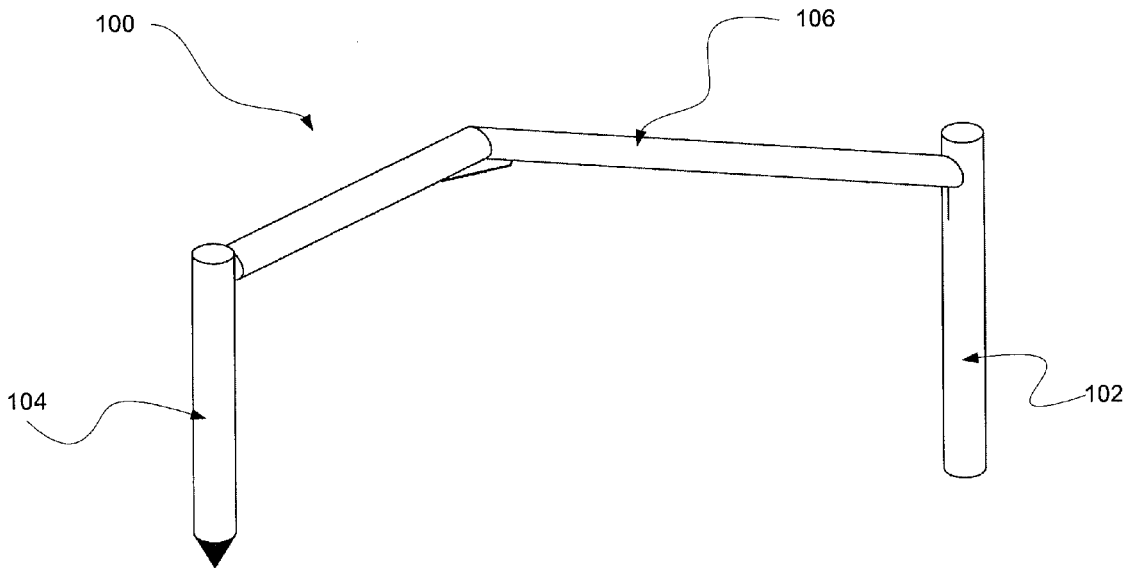
FIG. 1 illustrates an isometric view of an exemplary embodiment of the surface covering tool.

In accordance with an exemplary embodiment and referring to FIG. 1, a surface covering rollout tool 100 comprises: a handle 102, a mandrel 104, and a support member 106. The tool or the individual members of the tool may partially or fully comprise aluminum, steel, copper, magnesium, titanium, or other suitable durable metal, or various alloys of or variations on the same, such as stainless steel, A36 steel, galvanized steel, duralumin, silumin, 6061 aluminum, and the like, or any combination thereof. The tool may also partially or fully comprise a composite structure, a plastic structure, a carbon fiber structure, or other suitable material.

In various exemplary embodiments, handle 102 may comprise any structure configured for the user to grip and/or apply force against and that may transmit that force to various other structural features of the surface covering installation tool 100. For example, handle 102 may comprise a round cylinder of sufficient diameter and length for a user to comfortably hold with one or more hands. In another example, the handle may comprise an ergonomic shape or an ergonomic padded grip to allow the user a better and more comfortable hold. In another example, the handle may be a single hand grip configured to attach to another ridged member or to attach to a non ridged member such as a cable, rope, wire, etc.

In various exemplary embodiments, the handle may further comprise the addition of a feature that would allow the handle to connect to a harness or connected to another rollout tool. In one example, such a feature might include a ball detent for attaching a tube and/or connecting member to the handle. The tube and/or connecting member could connect the handle of one surface covering rollout tool 100 to the handle of another surface covering rollout tool 100. In another example, handle 102 might include a ring configured to attach a harness.

In various exemplary embodiments, mandrel 104 comprises a structure configured to insert into and/or along a center axis of a rolled surface covering. Mandrel 104 may be configured to allow the surface covering to rotate around the outside of the mandrel. The structure of the mandrel is further configured to provide sufficient strength, rigidity, and support to move the surface covering material. Mandrel 104 may be any of a suitable diameter and length to fit in the middle of the rolled surface covering. Different size and material of surface coverings may dictate the mandrels cross section and/or diameter such that mandrel 104 can be inserted into the center axis of the surface covering. In one example, mandrel 104 may have a tapered tip configured to insert mandrel 104 into a rolled surface covering easier. Once mandrel 104 is positioned inside the rolled surface covering along the center axis, the mandrel is configured to allow easy rotation of the floor covering. As such and in one exemplary embodiment, mandrel 104 comprises a round low friction material configured to have little friction between the mandrel and the surface covering. However, in another exemplary embodiment, the mandrel may comprise an inner element, a bearing, and an outer element. The outer tubular element being any suitable size and shape to insert into the middle of the rolled surface covering and suitable to support a bearing on the internal diameter. The inner element is configured to provide either a bearing surface or an external diameter on which the bearing may be mounted. In such an embodiment, the outer tubular element fits axially over the inner element and the respective mechanical or surface bearing so that the outer element can rotate with respect to the inner element.

Support member 106 comprises a structure configured to connect mandrel 104 and handle 102. Support member 106 must be of sufficient length to provide enough separation between handle 102 and mandrel 106 to allow mandrel 106 to insert into the center of a surface covering roll and handle 102 to extend away from the surface covering roll to a comfortable position for a worker to pull the roll. In an exemplary embodiment the length of support member 106 is adjustable to provide ideal lengths for different sized rolls and different sized workers.

In various embodiments, support member 106 is configured to transmit the force placed on the handle to a force between mandrel 106 and the rolled surface covering. As such, support member 106 needs to be strongest in tension allowing support member 106 to be constructed from either ridged or non-ridged materials. In one example, support member 106 may be constructed from cable, wire, rope or other non rigid material to connect the mandrel to the handle. In another example, support member 106 may be a ridged structure configured for strength in both tension and compression, such as tubes, channels, beams, etc.

Figure 2:
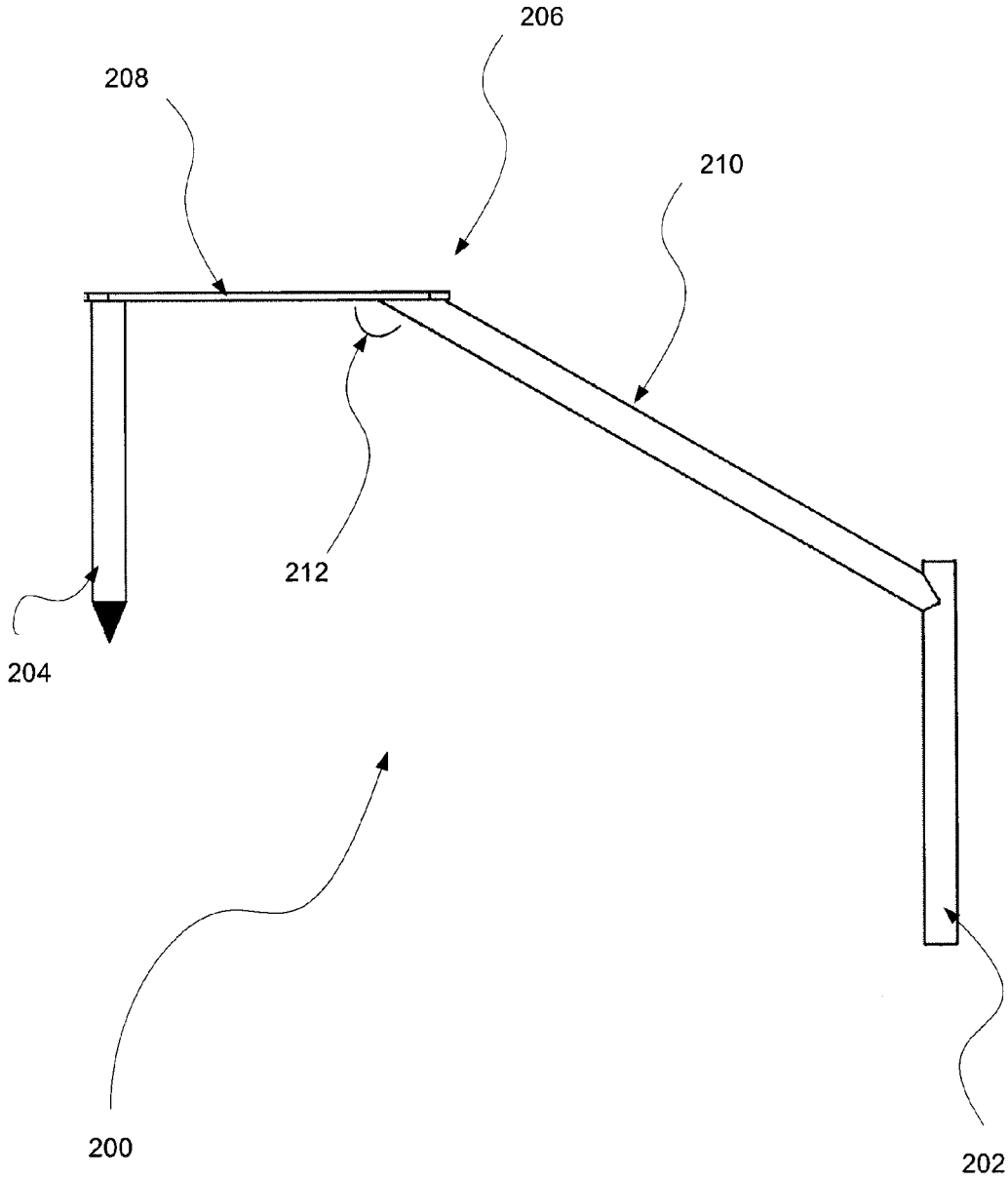
FIG. 2 illustrates a front view of another exemplary embodiment of the surface covering tool.

In another embodiment and with reference to FIG. 2, support member 206 and its connection to mandrel 204 has a narrow profile with a flat side 208 side on tool 200. This is accomplished by using a material with sufficient strength to have a small cross sectional area at the connecting point between support member 206 and mandrel 204 achieving a narrow profile and making support member 206 substantially flush with the side of mandrel 204. Having flat side 208 at the connecting point between mandrel 204 and support member 206 allows a worker to use tool 200 to roll out surface coverings close to vertical objects like walls or pillars.

In accordance with one embodiment, support member 206 may comprise a first length 208 connected to mandrel 204. Support member may also comprise a second length 210. In one embodiment, first length 208 and the second length 210 may be connected at an angle 212. Second length 210 may extend from first length 208 at angle 212 which may be in the same direction as mandrel 204 extends from first length 208.

In various exemplary embodiments and with reference to FIG. 1 (although all examples discussed below apply to FIG. 2 as well), surface covering installation tool 100 may be constructed by a variety of methods. For example, support member 106, mandrel 104, and handle 102 may include weldable materials, wherein support member 106 is welded to mandrel 104 and handle 102. However, in another example, support member 106, mandrel 104, and handle 102 may be cast, forged, or molded as one or multiple pieces. For example, covering installation tool 100 may be casted as one piece. In another example, covering installation tool 100 may be assembled in multiple pieces with either ridged joints or flexible joints. In one exemplary embodiment, the support member may be connected to the mandrel and the handle by hinges allowing handle 102 and mandrel 100 to collapse into support member 106 providing a smaller tool for storage or transportation.

In various other embodiments, the support member further comprises appendages that provide added functionality. In one exemplary embodiment, the support member has an appendage that functions as an additional handle. The additional handle may allow a user to easily pick up a roll of surface covering off the ground when mandrel is inserted through the center of the roll.

In another exemplary embodiment, the support member may have an appendage that functions as a tape dispenser allowing the user to tape down the surface covering as it is unrolled. In such an embodiment, an "L" shaped appendage may extend from the support member in the opposite direction from which the surface covering installation tool is pulled. The appendage may be positioned such that when a roll of tap is installed the tape lines up with its intended target.

In accordance with various exemplary embodiments of the present invention, the floor covering tool may be used in various methods. In one example, a method may comprise: locating a roll of surface covering near a desired area to be covered; positioning a first surface covering tool relative to the surface covering; inserting mandrel 104 into the center of the surface covering roll; applying a force or pulling handle 102 in the opposite direction of which the surface covering is rolled; and walking forward while continuing to apply the force on the handle until the surface covering is unrolled thus unrolling the surface covering over the desired area. Due to the low friction of mandrel 104 the rolled surface covering will have a tendency to roll in the direction it is being pulled.

In various exemplary embodiments, one or more tools and one or more tool operators may be required depending on the width of the particular surface covering being pulled. With narrow surface covering rolls only one tool and operator may be needed. With wide surface covering rolls, a tool and tool operator may be needed on each end of the surface covering. Using surface covering installation tool 100 in this method can reduce the installation time of a typical carpet section to less than thirty seconds. Thus the method of unrolling a surface covering might further include: positioning a second surface covering tool opposite the first surface covering tool; inserting a mandrel of the second surface covering tool in the center axis of the surface covering at an opposite end of the surface covering and using the second surface covering tool to aid in unrolling the covering.

In another exemplary embodiment, one tool operator could insert mandrel 104 in each side of a wide surface covering and then connect the handles of one or more tools together with either a long tube or a harness enabling one tool operator to unroll a wide surface covering using one or more tools.

Benefits, other advantages, and solutions to problems have been described herein with regard to specific embodiments. However, the benefits, advantages, or solutions are not to be construed as critical, required, or essential features or elements of any or all the claims of the invention. As used herein, the terms "comprises," "comprising," or any other variation thereof, are intended to cover a non-exclusive inclusion such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

What is claimed is:

1. A surface covering installation tool tier unrolling a rolled surface covering by a user, comprising:

a rigid round cylindrical handle configured to be gripped and have a force applied against it;

a cylindrical smooth mandrel configured to insert into the rolled surface covering, contacting the interior of the surface covering such that the surface covering rotates around the mandrel; and a rigid support member comprising at least a first length and a second length, wherein the first length has a flat cross section that rigidly connects with a first end of the mandrel, wherein the second length is a rigid tubular member that rigidly connects to the first length and extends at an obtuse angle in the same direction as the mandrel and rigidly connects to the handle, wherein the support member rigidly connects the mandrel and handle.

2. The surface covering installation tool of claim 1, wherein the first end of the mandrel connects substantially perpendicularly to a first side of the first length.

3. The surface covering installation tool of claim 1, wherein the mandrel has a second end that is tapered allowing for easier insertion into the rolled surface covering.

* * * * *